US009208736B2

(12) United States Patent
Choi et al.

(10) Patent No.: US 9,208,736 B2
(45) Date of Patent: Dec. 8, 2015

(54) DISPLAY DEVICE AND DRIVING METHOD THEREOF

(75) Inventors: Jae-Suk Choi, Uijeongbu-si (KR); Yong-Jun Choi, Asan-si (KR); Po-Yun Park, Seoul (KR); Yun-Jae Kim, Seoul (KR); Min Joo Lee, Seoul (KR); Jung Hwan Cho, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 557 days.

(21) Appl. No.: 13/483,666

(22) Filed: May 30, 2012

(65) Prior Publication Data

US 2013/0135330 A1 May 30, 2013

(30) Foreign Application Priority Data

Nov. 28, 2011 (KR) ..... 10-2011-0125169

(51) Int. Cl.
*G09G 3/36* (2006.01)

(52) U.S. Cl.
CPC ..... *G09G 3/3648* (2013.01); *G09G 2320/0285* (2013.01); *G09G 2320/103* (2013.01)

(58) Field of Classification Search
CPC ..... G09G 3/3648; G09G 2320/103; G09G 2320/0285; G09G 2340/0435; G09G 2320/0247; G09G 3/2092; G09G 2360/18
USPC ..... 345/690, 87
See application file for complete search history.

(56) References Cited

U.S. PATENT DOCUMENTS

| | | | |
|---|---|---|---|
| 6,005,542 | A | 12/1999 | Yoon |
| 7,102,604 | B2 | 9/2006 | Hong |
| 7,112,996 | B2 | 9/2006 | Lee |
| 7,362,295 | B2 | 4/2008 | Park et al. |
| 7,489,295 | B2 | 2/2009 | Honbo |
| 7,545,354 | B2 | 6/2009 | Ha et al. |
| 7,545,654 | B2 | 6/2009 | Berghegger |

(Continued)

FOREIGN PATENT DOCUMENTS

| | | |
|---|---|---|
| CN | 101188105 | 5/2008 |
| EP | 0838801 | 4/1998 |

(Continued)

OTHER PUBLICATIONS

US OA Dated Nov. 20, 2014 in U.S. Appl. No. 13/569,107.

*Primary Examiner* — Amare Mengistu
*Assistant Examiner* — Sarvesh J Nadkarni
(74) *Attorney, Agent, or Firm* — F. Chau & Associates, LLC

(57) ABSTRACT

A display device includes a display panel having gate lines and data lines, a signal controller driving the display panel, a graphic processing unit transmitting input image data to the signal controller, a gate driver driving the gate lines, and a data driver driving the data lines. The display panel is driven at a first frequency when displaying a moving image and driven at a lower frequency when displaying a still image. The signal controller includes a frame memory storing the input image data, a calculator calculating a representative value of image data stored in the frame memory, a line memory storing the representative value, and a kick-back corrector generating auxiliary image data by correcting the representative value according to a kick-back voltage. The data driver applies an auxiliary voltage corresponding to the auxiliary image data to the data lines in a vertical blank period when displaying the still image.

14 Claims, 6 Drawing Sheets

(56) References Cited

U.S. PATENT DOCUMENTS

| | | | | |
|---|---|---|---|---|
| 7,580,032 | B2 | 8/2009 | Jung et al. | |
| 7,612,505 | B2 | 11/2009 | Min et al. | |
| 7,724,218 | B2 | 5/2010 | Kim et al. | |
| 7,907,106 | B2 | 3/2011 | Shin et al. | |
| 8,692,823 | B2 | 4/2014 | Toyotaka et al. | |
| 2001/0024187 | A1 | 9/2001 | Sato et al. | |
| 2002/0067332 | A1 | 6/2002 | Hirakata et al. | |
| 2003/0030607 | A1 | 2/2003 | Kitagawa et al. | |
| 2004/0169627 | A1* | 9/2004 | Hong | 345/89 |
| 2004/0179002 | A1 | 9/2004 | Park et al. | |
| 2005/0068289 | A1 | 3/2005 | Diefenbaugh et al. | |
| 2005/0219196 | A1 | 10/2005 | Lee | |
| 2005/0253798 | A1 | 11/2005 | Hiyama et al. | |
| 2006/0038771 | A1 | 2/2006 | Hirakata et al. | |
| 2007/0091204 | A1 | 4/2007 | Koshimizu et al. | |
| 2007/0103424 | A1 | 5/2007 | Huang | |
| 2007/0132683 | A1 | 6/2007 | Kong | |
| 2007/0139427 | A1 | 6/2007 | Sahashi | |
| 2007/0176883 | A1 | 8/2007 | Hsu et al. | |
| 2008/0079701 | A1 | 4/2008 | Shin et al. | |
| 2008/0084379 | A1 | 4/2008 | Takahashi et al. | |
| 2008/0100553 | A1 | 5/2008 | Shen et al. | |
| 2008/0117223 | A1 | 5/2008 | Mayer et al. | |
| 2008/0224983 | A1* | 9/2008 | Lee et al. | 345/98 |
| 2009/0096769 | A1 | 4/2009 | Kim et al. | |
| 2009/0167659 | A1* | 7/2009 | Kim et al. | 345/89 |
| 2009/0244112 | A1 | 10/2009 | Jung et al. | |
| 2010/0165145 | A1 | 7/2010 | Kuroki | |
| 2010/0238193 | A1* | 9/2010 | Neal et al. | 345/596 |
| 2010/0302265 | A1 | 12/2010 | Sumi | |
| 2011/0025910 | A1 | 2/2011 | Furukawa et al. | |
| 2011/0148826 | A1* | 6/2011 | Koyama et al. | 345/204 |
| 2011/0157253 | A1 | 6/2011 | Yamazaki et al. | |
| 2011/0227955 | A1* | 9/2011 | Lee et al. | 345/690 |
| 2012/0268446 | A1 | 10/2012 | Yamauchi | |
| 2012/0320004 | A1 | 12/2012 | Kitakado | |
| 2013/0027379 | A1 | 1/2013 | Lee et al. | |

FOREIGN PATENT DOCUMENTS

| | | |
|---|---|---|
| JP | 06-267660 | 9/1994 |
| JP | 06-333695 | 12/1994 |
| JP | 07-191298 | 7/1995 |
| JP | 09-101506 | 4/1997 |
| JP | 10-111490 | 4/1998 |
| JP | 2001-013930 | 1/2001 |
| JP | 2004-061782 | 2/2004 |
| JP | 2005-091385 | 4/2005 |
| JP | 2005-234032 | 9/2005 |
| JP | 3718832 | 9/2005 |
| JP | 2006-073199 | 3/2006 |
| JP | 2006-091242 | 4/2006 |
| JP | 2006-228312 | 8/2006 |
| JP | 2007-039759 | 2/2007 |
| JP | 2007-267038 | 10/2007 |
| JP | 2008-098710 | 4/2008 |
| JP | 2009-069373 | 4/2009 |
| JP | 2009-075580 | 4/2009 |
| JP | 2010-066725 | 3/2010 |
| JP | 4469788 | 3/2010 |
| JP | 4586052 | 9/2010 |
| JP | 2010-273259 | 12/2010 |
| KR | 1020020072504 | 9/2002 |
| KR | 100374375 | 2/2003 |
| KR | 100400595 | 9/2003 |
| KR | 100840331 | 2/2004 |
| KR | 100480815 | 3/2005 |
| KR | 1020060058421 | 5/2006 |
| KR | 1020060066424 | 6/2006 |
| KR | 1020070039759 | 4/2007 |
| KR | 1020070066013 | 6/2007 |
| KR | 1020070076078 | 7/2007 |
| KR | 100767868 | 10/2007 |
| KR | 100770543 | 10/2007 |
| KR | 1020080002427 | 1/2008 |
| KR | 1020080035333 | 4/2008 |
| KR | 100834119 | 5/2008 |
| KR | 10084953 | 7/2008 |
| KR | 1020100131671 | 12/2010 |
| KR | 1020110070178 | 6/2011 |
| KR | 1020130012381 | 2/2013 |

* cited by examiner

DISPLAY DEVICE AND DRIVING METHOD THEREOF

CROSS-REFERENCE TO RELATED APPLICATION

This application claims priority to Korean Patent Application No. 10-2011-0125169, filed in the Korean Intellectual Property Office on Nov. 28, 2011, the disclosure of which is incorporated by reference in its entirety herein.

(a) Technical Field

Embodiments of the present invention relate to a display device and a driving method thereof, and more particularly, to a display device and a driving method thereof that can prevent a flicker from increasing due to an increase in leakage current while reducing power consumption.

(b) Discussion of Related Art

Various electronic devices such as computers, monitors, televisions, and cellular phones include a display device. As an example, the display device may be a cathode ray tube display, a liquid crystal display, or a plasma display device.

The display device may include a graphic processing unit (GPU), a display panel, and a signal controller. The graphic processing unit generates image data of a screen, and the signal controller generates a control signal for driving the display panel with the image data for display.

An image displayed on the display panel may include a still image or a moving image. The graphical processing unit may send the image data of the still image or the moving image to the signal controller for several image periods. However, when the still image is sent for several image periods, redundant image data is sent.

SUMMARY

At least one embodiment of the present invention has been made in an effort to provide a display device and a driving method thereof that prevents a flicker from increasing due to an increase in leakage current while reducing power consumption.

According to an exemplary embodiment of the present invention, a display device includes: a display panel, a signal controller, a graphic processing unit, a gate driver, and a data driver. The display panel includes gate lines and data lines. The display panel may be capable of displaying a still image and a moving image. The signal controller is configured to generating controls signals for driving the display panel. The graphic processing unit is configured to transmit input image data to the signal controller. The gate driver is configured to drive the gate lines. The data driver is configured driving the data lines. The display panel is driven at a first frequency when a moving image is displayed on the display panel and driven at a second frequency lower than the first frequency when a still image is displayed on the display panel. The signal controller includes a frame memory, a calculator, a line memory, and a kick-back converter. The frame memory is configured to store the input image data. The calculator is configured to calculate a representative value of the stored image data stored in the frame memory. The line memory is configured to store the representative value. The kick-back corrector is configured to generate auxiliary image data by correcting the representative value according to a kick-back voltage. The data driver is configured to apply an auxiliary voltage corresponding to the auxiliary image data to the data lines in a vertical blank period when the still image is displayed.

The graphic processing unit may transmit a still image start signal and a still image end signal to the signal controller.

The signal controller may store the input image data in the frame memory, apply the stored image data to the data driver, and deactivate transmission of the input image data by the graphical processing unit when the still image start signal is applied.

When the still image end signal is applied, the transmission of the input image data by the graphical processing unit may be activated and the input image data may be applied to the data driver.

The plurality of data lines may be provided, and the calculator may calculate the representative value of the stored image data for each data line.

The representative value may be an average gray value of the stored image data.

The representative value may be an average gray value of upper t bits of the stored image data. The parameter t may be a number less than a bit length of the stored image data.

The representative value may be a middle value of a maximum gray value and a minimum gray value of the stored image data.

The auxiliary image data may be a difference of the representative value and a kick-back correction gray value that depends on the representative value (e.g., Ga=Gr−dG, where Ga is the gray value of the auxiliary image data, Gr is the representative value, and dG is the kick-back correction gray value).

The kick-back correction gray value may be a value stored in a look-up table pattern or calculated by a function.

When the kick-back correction gray value is a value calculated by the function, the function may be generated by linear interpolation by using a kick-back correction gray value at a minimum gray, a kick-back correction gray value at a maximum gray, and a gray value when the magnitude of the kick back correction gray value is maximum.

According to an exemplary embodiment of the present invention, a driving method of a display device, includes (a) transmitting by a graphic processing unit, input image data to a signal controller and driving a display panel at a first frequency; (b) applying a still image start signal and storing the input image data in a frame memory; (c) transmitting stored image data stored in the frame memory to a data driver and driving the display panel at a second frequency lower than the first frequency; (d) calculating a representative value of the stored image data; (e) generating auxiliary image data by correcting the representative value according to kick-back voltage; (f) applying an auxiliary voltage corresponding to the auxiliary image data to data lines in a vertical blank period; and (g) applying a still image end signal and driving the display panel at the first frequency.

In the (b) step, when the still image start signal is applied, transmission of the input image data may be deactivated, and in the (g) step, when the still image end signal is applied, the transmission of the input image data may be activated.

The plurality of data lines may be provided, and in the (d) step, the representative of the stored image data may be calculated for each data line.

In the (d) step, the representative may be an average gray value of the stored image data.

In the (d) step, the representative may be an average gray value of upper t bits of the stored image data. The parameter t may be a number less than a bit length of the stored image data.

The representative value may be a middle value of a maximum gray value and a minimum gray value of the stored image data.

The auxiliary image data may be a difference of the representative value and a kick-back correction gray value that depends on the representative value (e.g., Ga=Gr−dG, where Ga is a gray value of the auxiliary image data, Gr is the representative value, and dG is the kick-back correction gray value).

The kick-back correction gray value may be a value stored in a look-up table pattern or calculated by a function.

When the kick-back correction gray value is a value calculated by the function, the function may be generated by linear interpolation by using a kick-back correction gray value at a minimum gray, a kick-back correction gray value at a maximum gray, and a gray value when the magnitude of the kick back correction gray value is maximum.

According to an exemplary embodiment of the invention, a driving method of a display device includes driving a display panel at a first frequency using image data received in a transmission, storing the image data in a frame memory in response to receipt of a still image start signal, transmitting stored image data stored in the frame memory to a data driver, driving the display panel at a second frequency lower than the first frequency using the transmitted stored image data, calculating a representative value of the stored image data, generating auxiliary image data by correcting the representative value according to kick-back voltage, applying an auxiliary voltage corresponding to the auxiliary image data to data lines of the display panel in a vertical blank period, and driving the display panel at the first frequency in response to receipt of a still image end signal.

According to an exemplary embodiment of the invention, a display device includes a display panel including gate lines and data lines, a gate driver configured to drive the gate line, a data driver configured to drive the data lines, a signal controller configured to control the gate and data driver, and a graphic processing unit configured to transmit image data to the signal controller. The signal controller drives the display panel at a first frequency when the transmit image data is a moving image and at a second frequency lower than the first frequency when the transmit image data is a still image. The signal controller includes a frame memory configured to store the transmit image data only when the input image data is the still image, a calculator configured to calculate an average value based on gray levels of the stored image data, and a kick-back corrector configured to generate auxiliary image data by correcting the average value according to a kick-back voltage. The data driver is configured to apply an auxiliary voltage corresponding to the auxiliary image data to the data lines in a vertical blank period when the still image is displayed.

The display device may include a main link through which the graphical processing unit transmits the image data to the signal controller and an auxiliary link through which the graphical processing unit transmits a signal indicating whether the transmitted image data is one of the moving image and the still image. The graphical processing unit may be deactivated when the signal indicates the transmitted image data is the still image.

In at least one embodiment of the invention, a display device is driven at a first frequency when displaying a moving image and at a second frequency lower than the first frequency when displaying a still image, thereby reducing power consumption.

Further, in at least one embodiment of the invention, a value representing a stored image data for each data line in a vertical blank period is calculated when a display panel is driven at the second frequency and an auxiliary voltage corresponding to a kick-back correction value is applied to a data line to reduce a leakage current and instances of a flicker.

DETAILED DESCRIPTION

Figure 1:
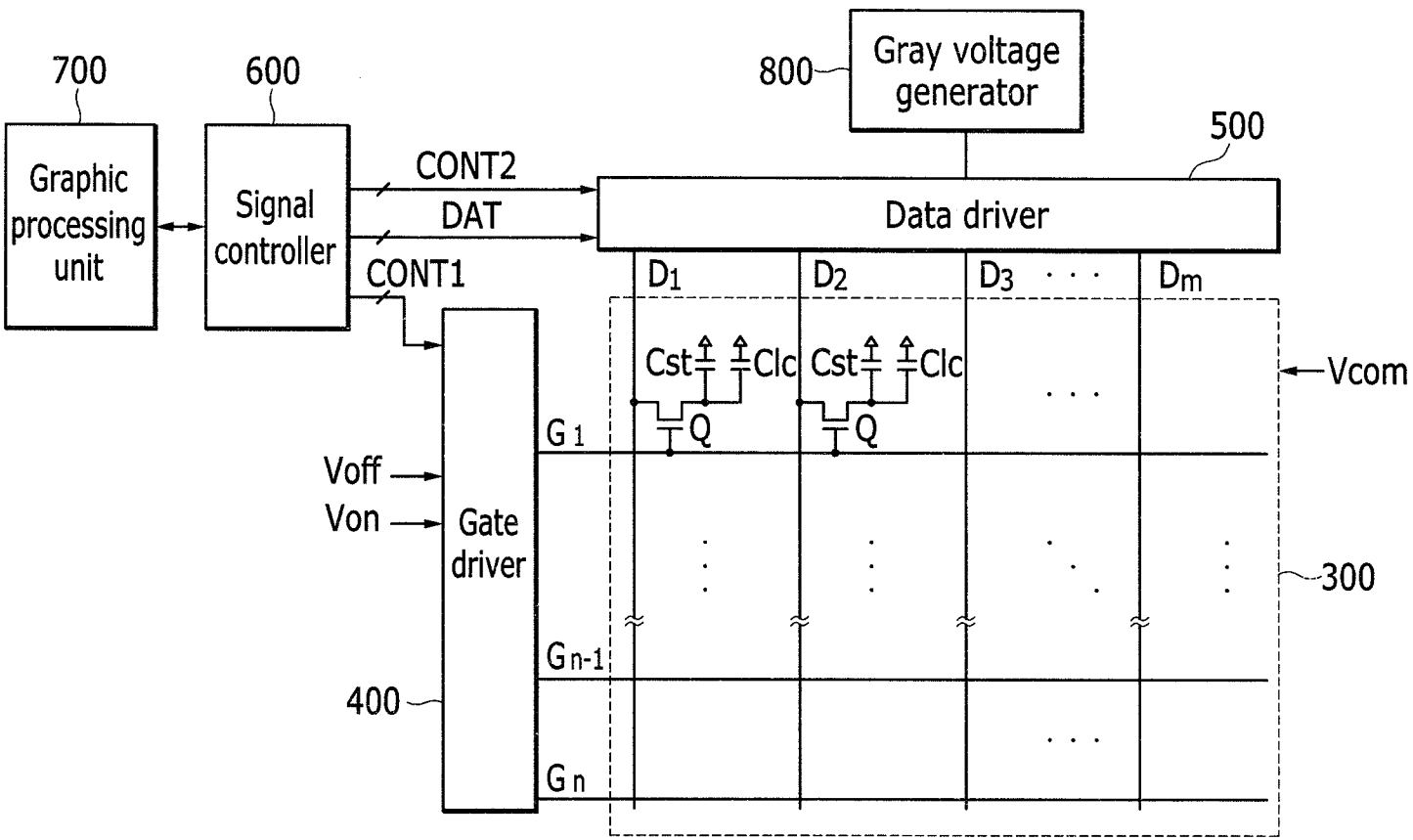
FIG. 1 is a block diagram of a display device according to an exemplary embodiment of the present invention.

Hereinafter, the present invention will be described more fully with reference to the accompanying drawings, in which exemplary embodiments thereof are shown. The described embodiments may be modified in various different ways, without departing from the spirit or scope of the disclosure.

In the drawings, the thickness of layers, films, panels, regions, etc., may be exaggerated for clarity. Like reference numerals designate like elements throughout the specification. It will be understood that when an element such as a layer, film, region, or substrate is referred to as being "on" another element, it can be directly on the other element or intervening elements may also be present.

As used herein, the singular forms, "a," "an" and "the" are intended to include the plural forms as well, unless the context clearly indicates otherwise.

FIG. 1 is a block diagram of a display device according to an exemplary embodiment of the present invention.

As shown in FIG. 1, the display device according to the exemplary embodiment of the present invention includes a display panel 300 displaying an image, a signal controller 600 generating signals for driving the display panel 300, and a graphic processing unit 700 transmitting input image data to the signal controller 600.

The display panel 300 may display a still image and a moving image (e.g., a motion picture). The display panel 300 displays the still image when image data input during several successive frames are the same as each other and the moving image when image data input during the successive frames are different from each other.

The display panel 300 includes a plurality of gate lines G1 to Gn and a plurality of data lines D1 to Dm. The plurality of gate lines G1 to Gn may extend in a horizontal direction and the plurality of data lines D1 to Dm may extend in a vertical direction while crossing the plurality of gate lines G1 to Gn.

One of the gate lines G1 to Gn and one of the data lines D1 to Dm are connected with one pixel, and a switching element Q connected with the gate lines G1 to Gn and the data lines D1 to Dm is included in the one pixel. A control terminal of the switching element Q is connected with a corresponding one of the gate lines G1 to Gn, an input terminal thereof is connected with a corresponding one of the data lines D1 to Dm, and an output terminal thereof is connected with a liquid crystal capacitor Clc and a storage capacitor Cst.

Although the display panel 300 of FIG. 1 is shown as a liquid crystal display panel, the present invention is not limited thereto as display panels of various types may be used. For example, in exemplary embodiments of the invention, the display panel 300 may be a plasma display, an organic light-emitting diode display, a light emitting diode display, etc.

The signal controller 600 processes input image data and control signals transmitted from the graphic processing unit 700. For example, the control signals may include at least one of a vertical synchronization signal Vsync, a horizontal synchronization signal Hsync, a main clock signal MCLK, and a data enable signal DE. The control signals may be generated by the graphic processing unit 700 in response to its receipt of the input image data. The control signals may be configured appropriately for operating the liquid crystal display panel 300. The signal controller may generate and output a gate control signal CONT1 and a data control signal CONT2 in response to the received control signals.

In an embodiment, the gate control signal CONT1 includes a vertical synchronization start signal STV commanding an output start of a gate-on pulse (e.g., a high period of a gate signal GS), a gate clock signal CPV controlling an output time of the gate-on pulse, etc.

In an embodiment, the data control signal CONT2 includes a horizontal synchronization start signal STH commanding an input start of image data DAT, and a load signal TP commanding application of a corresponding data voltage to the data lines D1 to Dm.

In an embodiment, the signal controller 600 adjusts control signals so that the display panel 300 is driven at a first frequency when the display panel 300 displays the moving image and the display panel 300 is driven at a second other frequency when the display panel 3 displays the still image. The signal controller 600 may increase a vertical black period between two neighboring frames further when the display panel 300 is driven at the first frequency to drive the display panel 300 at the second frequency. In an embodiment, the second frequency is lower than the first frequency.

For example, the first frequency may be 60 Hz, which represents that 60 frames are reproduced per second to display a screen. Further, the second frequency may be 10 Hz, which represents that 10 frames are reproduced per second to display the screen. However, the values listed for the first and second frequencies are examples, and embodiments of the invention are not limited thereto.

The graphic processing unit 700 transmits the input image data to the signal controller 600. When the display panel 300 displays the moving image, the graphic processing unit 700 transmits the input image data to the signal controller 600 for each frame. When the display panel 300 displays the still image, the signal controller 600 stores the input image data transmitted from the graphic processing unit 700 and thereafter, transmits the stored input image data to the display panel 300. As a result, the graphic processing unit 700 does not transmit the input image data to the signal controller 600. For example, when the display panel 300 displays the still image, the graphic processing unit 700 is deactivated.

At a conversion time when the graphic processing unit 700 transmits the input image data displaying the moving image and thereafter, transmits the input image data displaying the still image, the graphic processing unit 700 transmits a still image start signal to the signal controller 600. For example, the still image start signal is transmitted to the signal controller 600, and as a result, the signal controller 600 recognizes that the still image starts and controls the input image data to be stored.

Further, at a conversion time when the graphic processing unit 700 transmits the input image data displaying the still image and thereafter, transmits the input image data displaying the motion picture, the graphic processing unit 700 transmits a still image end signal to the signal controller 600. For example, the still image end signal is transmitted to the signal controller 600, and as a result, the signal controller 600 recognizes that the moving image starts and controls the input image data to be transmitted again.

In an embodiment, the signal controller 600 transmits a data stop signal to the graphic processing unit 700 in response to receipt of the still image start signal to request that the graphic processing unit 700 stop transmitting image data to the signal controller 600. In an embodiment, the signal controller 600 transmits a data start signal to the graphic processing unit 700 in response to receipt of the still image end signal to request that the graphic processing unit 700 transmit image data to the signal controller 600.

Although not shown, in an exemplary embodiment, the signal controller 600 and the graphic processing unit 700 are connected to each other through a main link (e.g., channel) and an auxiliary link (e.g., channel). In an embodiment, the graphic processing unit 700 transmits the input image data to the signal controller 600 through the main link. Further, in an embodiment, the graphic processing unit 700 transmits the still image start signal and the still image end signal to the signal controller 600 through the auxiliary link and the signal controller 600 transmits a signal indicating a driving state of the display panel 300 to the graphic processing unit 700.

In an exemplary embodiment, the display device further includes a gate driver 400 driving the gate lines G1 to Gn and a data driver 500 driving the data lines D1 to Dm.

The plurality of gate lines G1 to Gn of the display panel 300 are connected with the gate driver 400 and the gate driver 400 alternatively applies a gate-on voltage Von and a gate-off voltage Voff to the gate lines G1 to Gn according to the gate control signal CONT1 applied from the signal controller 600.

The plurality of data lines D1 to Dm of the display panel 300 is connected with the data driver 500 and the data driver 500 receives the data control signal CONT2 and the image data DAT from the signal controller 600. The data driver 500 converts the image data DAT into data voltages by using gray voltages generated by a gray voltage generator 800 and transfers the converted data voltages to the data lines D1 to Dm. The image data DAT may be any one of the input image data, stored image data, and auxiliary image data, which will be described in more detail below.

Figure 2:
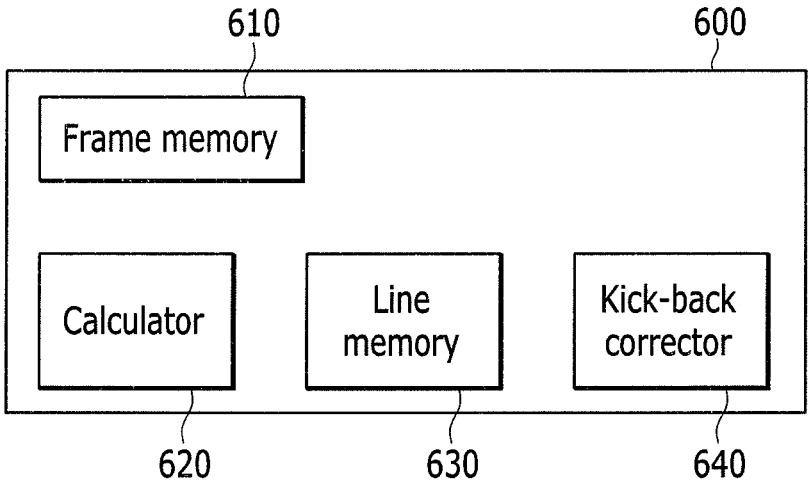
FIG. 2 is a block diagram of a signal controller of the display device according to an exemplary embodiment of the present invention.

FIG. 2 is a block diagram of a signal controller of the display device according to an exemplary embodiment of the present invention.

In an embodiment, the signal controller 600 includes a frame memory 610 storing the input image data, a calculator 620 calculating a representative value of the stored image data stored in the frame memory, a line memory 630 storing the representative value, and a kick-back corrector 640 generating auxiliary image data by correcting the representative value.

The frame memory 610 stores the input image data transmitted from the graphic processing unit 700. In an embodiment, the frame memory 610 is not used when the display panel displays the moving image, but is used when the display panel displays the still image. When the still image start signal is applied, the input image data is stored in the frame memory 610 and the display panel 300 is driven by using the stored image data stored in the frame memory 610.

The calculator 620 receives the stored image data from the frame memory 610 to calculate the representative value representing the stored image data. In an embodiment, the representative value is calculated for each of the data lines D1 to Dm.

The stored image data (e.g., capable of displaying one frame) is stored in the frame memory 610 and the stored image data is divided for each of the data lines D1 to Dm. For example, the stored image data is divided into stored image data corresponding to a first data voltage to be applied to a first data line D1, stored image data corresponding to a second data voltage to be applied to a second data line D2, stored image data corresponding to a third data voltage to be applied to a third data line D3, and stored image data corresponding to an m-th data voltage to be applied to an m-th data line Dm.

The calculator 620 receives the stored image data for each of the data lines D1 to Dm to calculate the representative value representing the stored image data. For example, the calculator 620 calculates a first representative value representing the stored image data corresponding to the first data voltage to be applied to the first data line D1 and calculates a second representative value representing the stored image data corresponding to the second data voltage to be applied to the second data line D2. By this method, a third representative value, an m-th representative value, and the like are calculated.

The representative value representing the stored image data may be calculated using various methods.

Hereinafter, various methods of calculating the representative value according to exemplary embodiments of the invention will be described below with reference to Table 1.

Table 1 shows a gray value of the stored image data corresponding to the first data voltage to be applied to the first data line D1. The number of stored image data corresponding to a data voltage applied to one of the data lines D1 to Dm may be the same as the number of the gate lines G1 to Gn.

TABLE 1

| Stored image data | Gray value |
|---|---|
| d11 | 00100110 |
| d12 | 00101010 |
| d13 | 00111101 |
| d14 | 00111011 |
| d15 | 00111011 |
| d16 | 00101101 |
| . . . | . . . |
| d1n | 00110001 |

In a first method according to an exemplary embodiment of the invention, an average gray value Gr of the stored image data is set as the representative value and calculated according to Equation 1.

$$Gr = \sum_{p=1}^{n} \frac{dlp}{n}$$

where Gr is the representative value and n is the number of stored image data.

In Table 1, when the average gray value is calculated on the assumption that n is 7, the average gray value is 00110010. For example, the storage image data values are summed together and divided by the number of values that are present. For example, when n is 2, d11=0x2A and d12=0x2C, the average gray value Gr would be 0x2B, i.e., (0x2A+0x2C)/2.

In a second method according to an exemplary embodiment of the invention, an average gray value Gr of upper t bits of the stored image data may be set as the representative value. In this embodiment, a value for t may be variously set. For example, the value for t may be set to 3 or 4 when the bit length of the stored image data is 8 bits. However, exemplary embodiments of the invention are not limited thereto as t could be larger than 3 or greater than 4 and the bit length can be larger or smaller than 8 bits.

The below example, assumes that t is 4 and the bit length is 8 bits. In this example, the upper 4 bits of the stored image data are extracted to generate an average grey value Gr. When d11, d12, d13, d14, d15, d16, and d17 have upper 4-bit gray values such as 0010, 0010, 0011, 0011, 0011, 0010, and 0011, the average value thereof is 0011 and the representative value is 00110000. In another example, when t is 3, and d11, d12, d13, d14, d15, d16, and d18 have upper 3-bit gray values such as 001, 011, 001, 011, 010, 011, and 010, the average value thereof is 010 and the representative value is 01000000.

In a third method according to an exemplary embodiment of the invention, a middle value of a maximum gray value and a minimum gray value of the stored image data may be set as the representative value. In Table 1, the maximum gray value of the stored image data is 00111101 and the minimum gray value is 00100110. The calculated middle value thereof is 00110010. In an embodiment, the middle value is exactly or about halfway between the minimum and the maximum gray values. For example, if the majority of values are 00111101, there is a maximum value of 00111110 and a minimum value of 00111010, the middle value could be 00111100.

As discussed above, the representative values calculated by the three methods could be 00110010, 00110000, and 00110010, respectively. In this example, when the representative values are expressed by decimals, the decimals are 50, 48, and 50, respectively. Therefore, in some embodiments, the representative values are not largely different from each other in spite of following different methods. It is believed that the values computed by the first method are optimal over the values computed by the second and third methods. However, it may take more time to perform the first method as compared to the second and third methods. Thus, the second or third methods may be chosen when minimal computation times are necessary and less than optimal representative values are acceptable.

The line memory 630 receives and stores the representative value from the calculator 620. In this example, since the representative value is provided for each data line, the representative value is stored for each data line. For example, each of the first representative value, the second representative value, the third representative value, the m-th representative value, and the like is stored.

The kick-back corrector 640 corrects the representative value stored in the line memory 630 according to a kick-back voltage to generate the auxiliary image data.

The data voltage applied from the data lines D1 to Dm is charged in each pixel connected to the gate lines G1 to Gn and the data lines D1 to Dm and the charged voltage is referred to as pixel voltage. The pixel voltage may be reduced by a parasitic capacitance while the switching element Q is turned off and in this example, the reduced voltage is referred to as kick-back voltage.

The kick-back corrector 640 generates auxiliary image data having a value most approximate to a gray value corresponding to pixel voltage charged in a pixel array connected to one of the data lines D1 to Dm when the switching element Q is turned off. For example, the auxiliary image data has a value approximate to a gray value corresponding to a pixel voltage which is reduced by the kick-back voltage.

The kick-back voltage depends on the magnitude of a data voltage applied to a corresponding pixel. For example, the kick-back voltage depends on the gray value of the image data corresponding to the data voltage and may be verified through FIG. 3.

Figure 3:
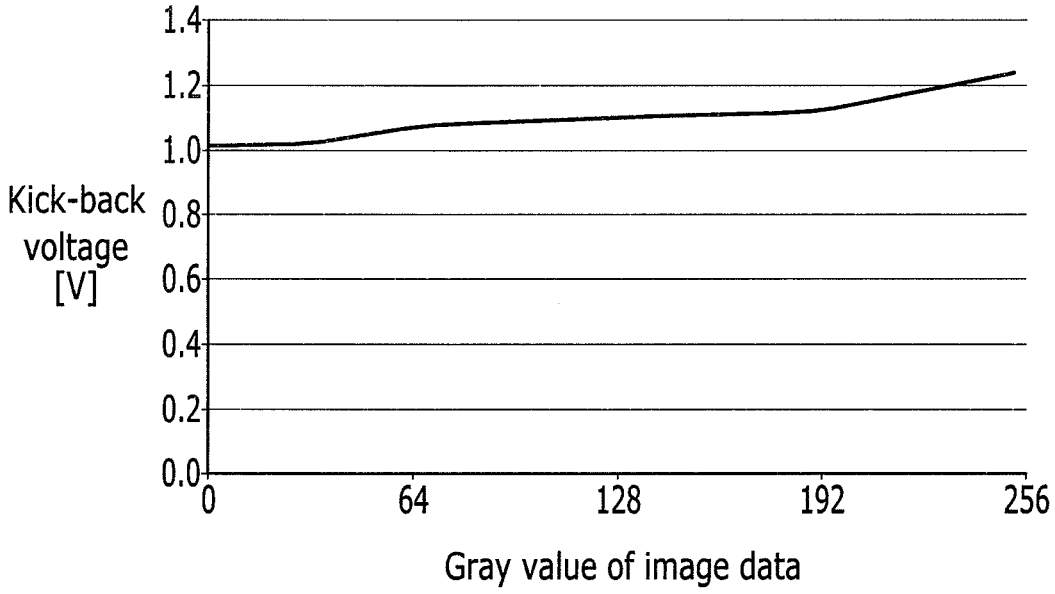
FIG. 3 is a graph illustrating an exemplary kick-back voltage depending on a gray value of image data.

FIG. 3 is a graph illustrating a kick-back voltage depending on a gray value of image data.

Referring to FIG. 3, as the gray value of the image data increases so does the kick-back voltage. For example, a kick-back voltage of gray 0 is approximately 1.0 V and kick-back voltage of gray 256 is approximately 1.2 V. However, embodiments of the invention are not limited thereto, as the kick-back voltage values shown in FIG. 3 are examples since these values depend on the specification of the display device.

The kick-back voltage differs according to the gray value of the image data, but the difference may not be large. For example, in FIG. 3, the kick-back voltages for gray scales between 0 and 256 vary by about 0.2 volts. Therefore, in an embodiment, voltages for correction depending on the kick-back voltage are set to the same voltage. For example, it may be assumed that the kick-back voltage is 1V regardless of the size (e.g., bit length) of the image data.

However, even if it is assumed that the kick-back voltage is 1V regardless of the size of the image data, the gray value corresponding to 1V depends on the gray value of each image data since voltage and transmittance have a non-linear relationship. Accordingly, the gray value corresponding to the kick-back voltage (e.g., a kick-back correction gray value according to the gray value of the image data) may be acquired from a voltage-transmittance curve (V-T curve) of each display device.

Hereinafter, a method of acquiring the kick-back correction gray value according to an exemplary embodiment of the invention will be described with reference to FIG. 4.

Figure 4:
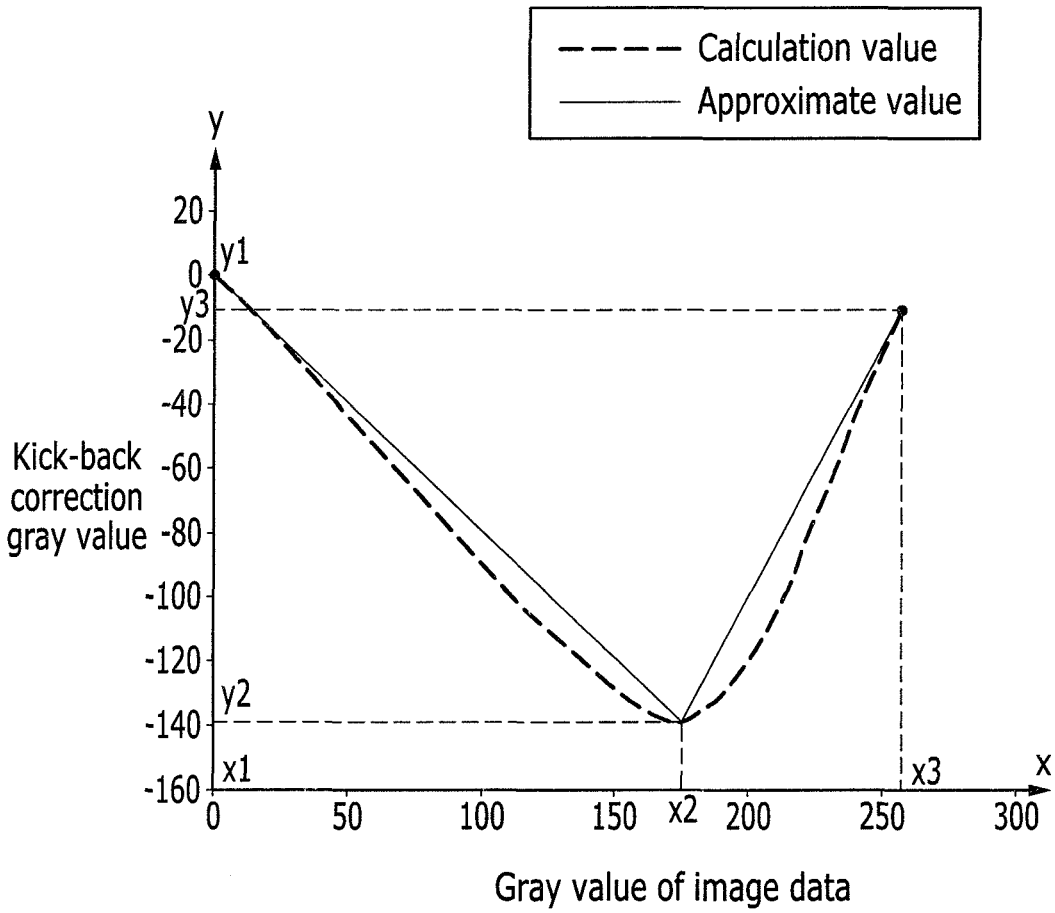
FIG. 4 is a graph illustrating an exemplary kick-back correction gray value depending on the gray value of the image data.

FIG. 4 is a graph illustrating a kick-back correction gray value depending on the gray value of the image data. Dotted lines represent a calculation value acquired by a calculation and a solid line represents an approximate value generated by using a calculation value.

A method of acquiring the kick-back correction gray value by the calculation will be described below according to an exemplary embodiment of the invention.

Second image data corresponding to a second data voltage acquired by subtracting the kick-back voltage from first data voltage corresponding to a predetermined first image data is acquired. A value acquired by subtracting a gray value of the second image data from a gray value of the first image data is the kick-back correction gray value. By using such a method, the kick-back correction gray values for all the first image data may be acquired and may be expressed in a look-up table. Further, when the kick-back correction gray values acquired by the calculation are expressed in the graph, the kick-back correction gray values are marked with dotted lines of FIG. 4.

The kick-back correction gray values depending on the representative value of the stored image data may be acquired by using the look-up table prepared by the calculation.

Subsequently, a method of acquiring the kick-back correction gray value through approximation by using a calculation value will be described below according to an exemplary embodiment of the invention.

Referring to FIG. 4, when the image data is approximately a gray value of 175, the kick-back correction gray value is the largest. Further, when the image data is in a range smaller than approximately a gray value of 175, as the gray value decreases so does the magnitude of the kick-back correction gray value. When the image data is in a range larger than approximately a gray value of 175, as the gray value becomes larger, the magnitude of the kick-back correction gray value becomes smaller. In this example, variation in the kick-back correction gray value depending on the gray value of the image data shows non-linearity, but the variation has a pattern close to linearity.

Therefore, a function of the kick-back correction gray value depending on the gray value of the image data may be generated by using linear interpolation. In this example, a function of Equation 2 may be generated by using a kick-back correction gray value y1 at a minimum gray x1, a kick-back correction gray value x3 at a maximum gray x2, and a gray value y2 when the magnitude of the kick-back correction gray value is a maximum y2.

$$y = \begin{cases} \dfrac{y1 - y2}{x1 - x2}x + \dfrac{y2x1 - y1x2}{x1 - x2} & (\text{if, } x \le x2) \\ \dfrac{y2 - y3}{x2 - x3}x + \dfrac{y3x2 - y2x3}{x2 - x3} & (\text{if, } x > x2) \end{cases} \quad \text{(Equation 2)}$$

In the function of Equation 2, a y value when the representative value of the stored image data is input into x becomes the kick-back correction gray value.

Hereinafter, a method of generating the auxiliary image data by using the kick-back correction gray value will be described according to an exemplary embodiment of the invention.

As shown in Equation 3, a value acquired by subtracting the kick-back correction gray value depending on the representative value from the representative value of the stored image data is a gray value of the auxiliary image data.

$$Ga = Gr - dG \quad \text{(Equation 3)}$$

Referring to Equation 3, the parameter Ga is the gray value of auxiliary image data, the parameter Gr is the representative value, and the parameter dG is a kick-back correction gray value depending on the representative value.

The kick-back corrector 640 transmits the auxiliary image data generated by using Equation 3 to the data driver 500 and the data driver 500 applies an auxiliary voltage corresponding to the auxiliary image data to the data lines D1 to Dm in the vertical blank period when displaying the still image.

The image data which the signal controller 600 transmits to the data driver 500 is summarized for each case as follows.

The signal controller 600 transmits the input image data transmitted from the graphic processing unit 700 to the data driver 500 to drive the display panel 300 at the first frequency when displaying the moving image. The signal controller 600 transmits the stored image data stored in the frame memory 610 to the data driver 500 to drive the display panel 300 at the second frequency when displaying the still image. Further, the signal controller 600 transmits the auxiliary image data correcting the representative value of the stored image data to the data driver 500 to apply the auxiliary voltage to the data line in the vertical blank period when displaying the still image.

Next, referring to FIGS. 5 and 6, a principle of reducing leakage current by inputting the auxiliary image data in the vertical blank period when displaying the still image in the display device according to an exemplary embodiment of the present invention will be described.

Figure 5:
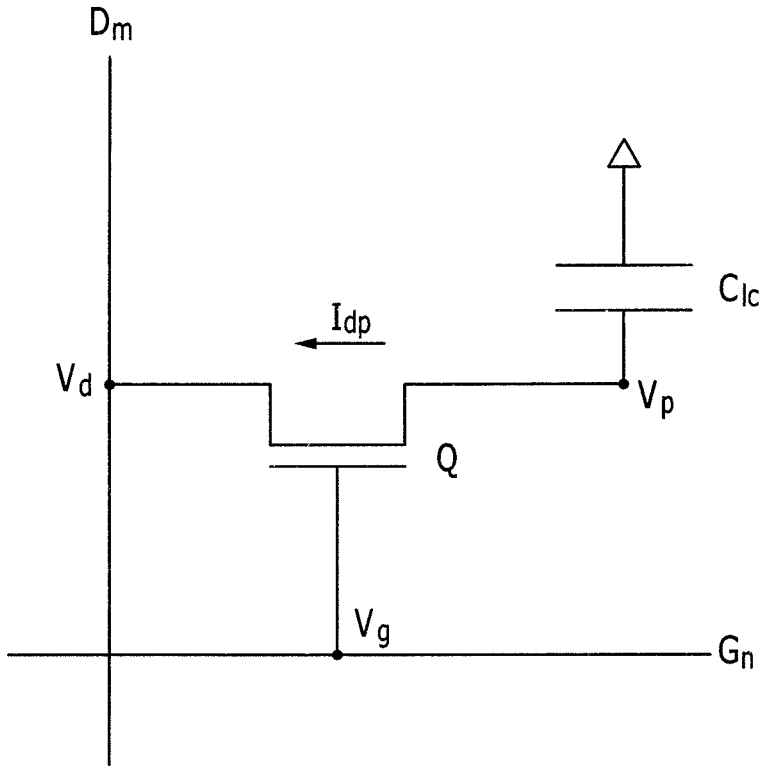
FIG. 5 is an equivalent circuit diagram for one pixel of the display device according to an exemplary embodiment of the present invention.
Figure 6:
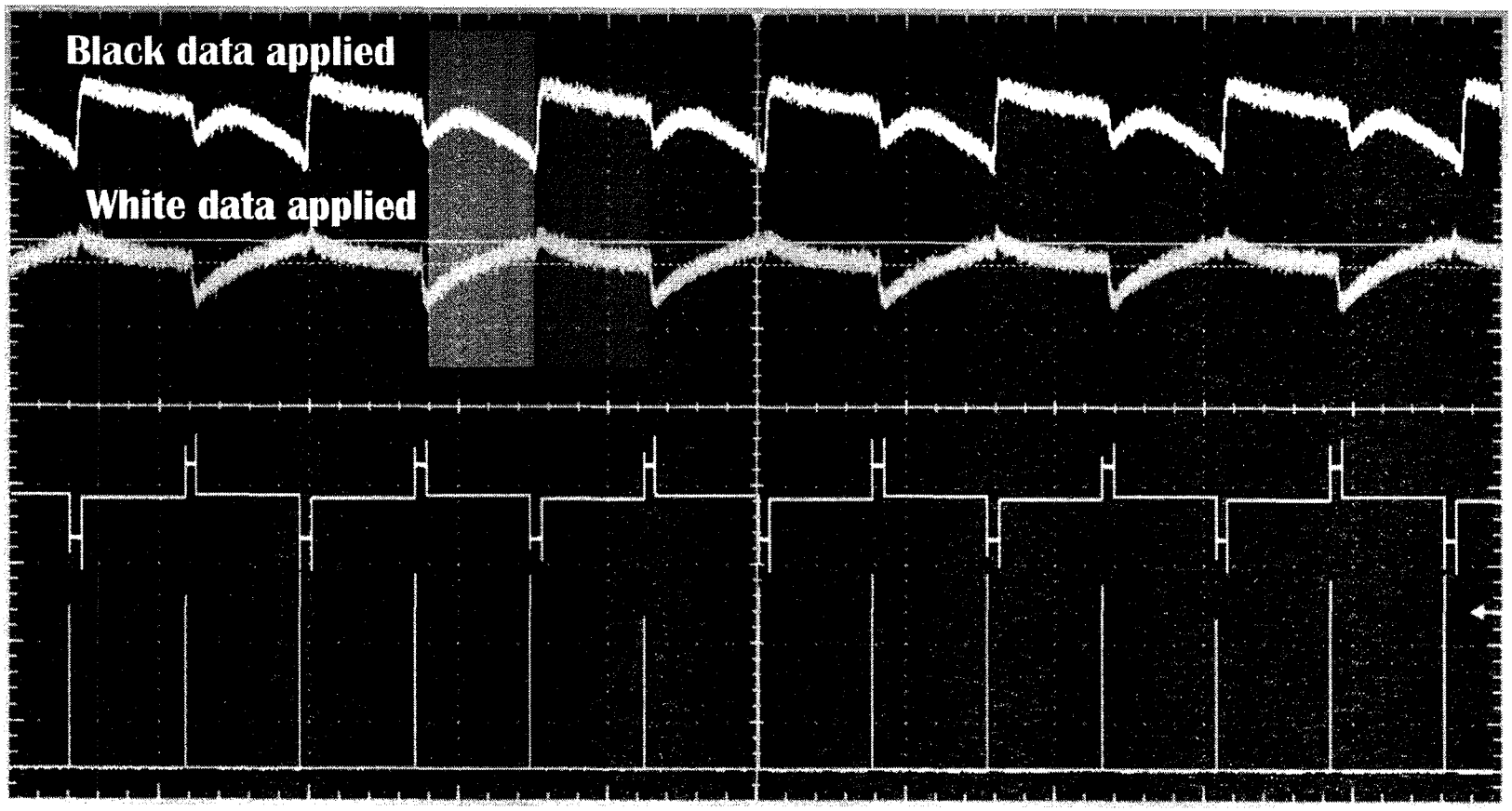
FIG. 6 is a diagram illustrating a leakage current when a predetermined voltage is applied during a vertical blank period in a display device according to an exemplary embodiment of the present invention.

FIG. 5 is an equivalent circuit diagram for one pixel of the display device according to an exemplary embodiment of the present invention and FIG. 6 is a diagram illustrating leakage current when a predetermined voltage is applied during a vertical blank period in the display device according to an exemplary embodiment of the present invention. The vertical blank period may be a time period in which image data is not displayed on a display panel of the display device.

As shown in FIG. 5, the switching element Q is formed so that one pixel of the display device according to an exemplary embodiment of the present invention is connected to the gate line Gn and the data line Dm. In the switching element Q (e.g., a 3-terminal element such as a thin-film transistor), a control terminal is connected with the gate line Gn, an input terminal is connected with the data line Dm, and an output terminal is connected with a liquid crystal capacitor Clc.

When the gate-on voltage is applied to the gate line Gn and the data voltage is applied to the data line Dn, the liquid crystal capacitor Clc is charged. Subsequently, when the gate-off voltage is applied to the gate line Gn to turn off the switching element Q, no current should flow between the input terminal and the output terminal of the switching element Q. However, leakage current Idp that flows into the input terminal from the output terminal of the switching element Q may be generated due to a characteristic of the switching element Q such as the thin-film transistor. The leakage current Idp may be proportionate to a difference between voltage Vd of the input terminal and a voltage Vp of the output terminal of the switching element Q.

In an embodiment where the data voltage is not input during the vertical blank period between two neighboring frames, a voltage difference between the input terminal and the output terminal of the switching element Q is large. The leakage current is increased due to the voltage difference between the input terminal and the output terminal of the switching element Q when the display panel is driven at a low frequency by increasing the length of the vertical blank period between two frames.

In at least one exemplary embodiment of the present invention, the display panel is driven at the low frequency when displaying the still image and a predetermined voltage is applied to the data line in the vertical blank period to reduce the leakage current.

As shown in FIG. 6, the leakage current is changed when a data voltage corresponding to a black gray is applied to the data line and a data voltage corresponding to a white gray is applied to the data line in the vertical blank period.

In this example, the predetermined voltage applied to the data line may be set to a value that most closely approximates the pixel voltage charged in the liquid crystal capacitor Clc of each pixel (e.g., the voltage of the output terminal of the switching element Q).

According to at least one exemplary embodiment of the present invention, the value representing the stored image data is calculated for each data line and the calculated value is corrected according to the kick-back voltage to generate the auxiliary image data and thereafter, the auxiliary voltage corresponding thereto is applied to the data line.

Accordingly, the voltage between the input terminal and the output terminal of the switching element Q can be minimized, and as a result, the leakage current can also be minimized.

While this invention has been described in connection with exemplary embodiments thereof, it is to be understood that the invention is not limited to the disclosed embodiments, but, on the contrary, is intended to cover various modifications and equivalent arrangements included within the spirit and scope of the disclosure.

What is claimed is:

1. A display device, comprising:

a display panel including gate lines and data lines;

a signal controller configured to generate control signals for driving the display panel;

a graphic processing unit configured to transmit input image data to the signal controller;

a gate driver configured to drive the gate lines; and a data driver configured to drive the data lines, wherein the display panel is driven at a first frequency when a moving image is displayed on the display panel and driven at a second frequency lower than the first frequency when a still image is displayed on the display panel, wherein the signal controller comprises:

a frame memory configured to store the input image data;

a calculator configured to calculate a representative value of the stored image data stored in the frame memory;

a line memory configured to store the representative value; and a kick-back corrector configured to generate auxiliary image data by correcting the representative value according to a kick-back voltage, and wherein the data driver is configured to apply an auxiliary voltage corresponding to the auxiliary image data to the data lines in a vertical blank period when the still image is displayed, wherein the auxiliary image data is a difference of the representative value and a kick-back correction gray value that depends on the representative value, and wherein the kick-back correction gray value is a value calculated by a function generated by linear interpolation using a kick-back correction gray value at a minimum gray, a kick-back correction gray value at a maximum gray, and a gray value when the magnitude of the kick back correction gray value is maximum.

2. The display device of claim 1, wherein the graphic processing unit is configured to transmit a still image start signal and a still image end signal to the signal controller.

3. The display device of claim 2, wherein the signal controller stores the input image data in the frame memory, applies the stored image data to the data driver, and deactivates transmission of the input image data by the graphical processing unit when the still image start signal is applied.

4. The display device of claim 3, wherein when the still image end signal is applied, the signal controller activates transmission of the input image data by the graphical processing unit and applies the transmitted input image data to the data driver.

5. The display device of claim 4, wherein the calculator is configured to calculate the representative value of the stored image data for each data line.

6. The display device of claim 5, wherein the representative value is an average gray value of the stored image data.

7. The display device of claim 5, wherein the representative value is an average gray value of upper t bits of the stored image data, where t is a number less than a bit length of the stored image data.

8. The display device of claim 5, wherein the representative value is a middle value of a maximum gray value and a minimum gray value of the stored image data.

9. A driving method of a display device, comprising:

driving a display panel at a first frequency using image data received in a transmission;

storing the image data in a frame memory in response to receipt of a still image start signal;

transmitting stored image data stored in the frame memory to a data driver;

driving the display panel at a second frequency lower than the first frequency using the transmitted stored image data;

calculating a representative value of the stored image data;

generating auxiliary image data by correcting the representative value according to kick-back voltage;

applying an auxiliary voltage corresponding to the auxiliary image data to data lines of the display panel in a vertical blank period; and driving the display panel at the first frequency in response to receipt of a still image end signal, wherein the auxiliary image data is a difference of the representative value and a kick-back correction gray value that depends on the representative value, and wherein the kick-back correction gray value is a value calculated by a function generated by linear interpolation using a kick-back correction gray value at a minimum gray, a kick-back correction gray value at a maximum gray, and a gray value when the magnitude of the kick back correction gray value is maximum.

10. The driving method of a display device of claim 9, wherein when the still image start signal is applied, transmission of the image data is deactivated, and when the still image end signal is applied, the transmission of the image data is activated.

11. The driving method of a display device of claim 10, wherein the representative value of the stored image data is calculated for each data line.

12. The driving method of a display device of claim 11, wherein the representative value is an average gray value of the stored image data.

13. The driving method of a display device of claim 11, wherein the representative value is an average gray value of upper t bits of the stored image data, where t is a number less than a bit length of the stored image data.

14. The driving method of a display device of claim 11, wherein the representative value is a middle value of a maximum gray value and a minimum gray value of the stored image data.

* * * * *